US011408160B2

(12) United States Patent
Goldsmith

(10) Patent No.: US 11,408,160 B2
(45) Date of Patent: Aug. 9, 2022

(54) RESLIENT FLUID CONTROL VALVE ABOVE DRAINAGE PLANE

(71) Applicant: Falcon Water Technologies, LLC, Los Angeles, CA (US)

(72) Inventor: Edward Michael Goldsmith, Encino, CA (US)

( * ) Notice: Subject to any disclaimer, the term of this patent is extended or adjusted under 35 U.S.C. 154(b) by 0 days.

(21) Appl. No.: 16/844,814

(22) Filed: Apr. 9, 2020

(65) Prior Publication Data

US 2020/0325667 A1 Oct. 15, 2020

Related U.S. Application Data

(60) Provisional application No. 62/831,599, filed on Apr. 9, 2019.

(51) Int. Cl.
*E03C 1/298* (2006.01)

(52) U.S. Cl.
CPC ..... *E03C 1/298* (2013.01)

(58) Field of Classification Search
CPC E03C 1/298; E03F 5/0407; E03F 2005/0417; F16K 15/148
See application file for complete search history.

(56) References Cited

U.S. PATENT DOCUMENTS 6,318,397 B1 11/2001 Huber et al.
6,401,266 B1 6/2002 Mitchell et al.
2006/0260703 A1* 11/2006 Johnson ..... F16K 15/148 137/854
2012/0167295 A1 7/2012 Fima
2015/0074892 A1* 3/2015 Kokarakis ..... E03C 1/298 4/306
2015/0300511 A1 10/2015 Fima
2016/0201309 A1* 7/2016 Kosarnig ..... E03C 1/288 137/854

(Continued)

FOREIGN PATENT DOCUMENTS

NL 1015745 C2 7/2000
WO 2011-067579 A1 6/2011
WO WO 2015024965 A1 2/2015

OTHER PUBLICATIONS

Notification of Transmittal of The International Search Report, and the Written Opinion of the International Searching Authority for PCT/US2020/027530; dated Jul. 30, 2020.

(Continued)

*Primary Examiner* — Reinaldo Sanchez-Medina
*Assistant Examiner* — Nicole Gardner
(74) *Attorney, Agent, or Firm* — Tope-McKay & Associates

(57) ABSTRACT

Described is a resilient fluid control valve assembly. The resilient fluid control valve assembly includes a cartridge housing having an upper portion and a lower portion. The upper portion is formed to reside above a drain opening, while the lower portion is formed to reside within the drain opening. The resilient fluid control valve assembly further includes a resilient fluid control valve positioned within the cartridge housing. The resilient fluid control valve has a valve body portion and a sealing portion. When positioned within the cartridge housing, a portion of the valve body portion resides above the drain opening, and a portion of the sealing portion resides within the drain opening.

5 Claims, 5 Drawing Sheets

(56) References Cited

U.S. PATENT DOCUMENTS

| | | | |
|---|---|---|---|
| 2017/0198469 | A1 | 7/2017 | Wachter et al. |
| 2019/0112800 | A1 | 4/2019 | Goldsmith |

OTHER PUBLICATIONS

The International Search Report, and the Written Opinion of the International Searching Authority for PCT/US2020/027530; dated Jul. 30, 2020.

* cited by examiner

RESLIENT FLUID CONTROL VALVE ABOVE DRAINAGE PLANE

CROSS-REFERENCE TO RELATED APPLICATIONS

This is a Non-Provisional patent application of U.S. Provisional Application No. 62/831,599, filed in the United States on Apr. 9, 2019, entitled, "Resilient Fluid Control Valve Above Drainage Plane," the entirety of which is hereby incorporated by reference.

BACKGROUND OF THE INVENTION

(1) Field of Invention

The present invention relates to a resilient fluid control valve assembly and, more particularly, to a resilient fluid control valve assembly where a portion of the resilient fluid control valve resides above the opening of the urinal drain hole.

(2) Description of Related Art

Fluid control valves allow liquid to flow in one direction and prevent gaseous flow in the opposite direction. One application for a fluid control valve is in drains which are connected to the sewer system. Here, it is necessary to permit flow through the valve into a sewer system while preventing reverse flow of malodorous gas in the reverse direction. Typically, the entire fluid control valve resides below the opening plane of the drain in order to allow liquids to flow through the valve, and not pool on the surface of the urinal or floor drain. This can be particularly useful in urinals in which the water trap has been removed, or in which regular flushing does not occur with each use as in a urinal application. These applications often have fluid flowing through them in the first direction, which has solids of one form or another suspended within it. Even flushing water can have solids, such as calcium, suspended in it, which can form on any valve surface as the liquid evaporates, leading to build up of solids, or precipitates. WO 2015/024965 (hereinafter referred to as the '965 publication) by Geberit International attempts to deal with these solids by creating a serrated drip edge for the valve member. Valves, such as that described in the '965 publication, reside below the drain opening so that fluids can flow through them using only gravity, and no fluids are left behind in the urinal bowl or floor area surrounding the drain.

With some configurations, like hybrid flushing, and some water free configurations, a fluid trap is already in the urinal, allowing the urinal to meet local codes. However, if it is desired not to wash out the trap with every use, then some form of odor block is required between the user and the waste holding trap. Additionally, should the trap be removed, this odor block is still required to keep gas from entering the restroom.

Examples of valves that can be used as traps include flattened flexible and, preferably, resilient tubes extending from a wide inlet section. These valves were developed from drain-tube valves used in watercraft. The valves known to the Applicant have been described in U.S. Pat. No. 6,401,266 (hereinafter referred to as the '266 patent), Netherlands Patent No. NL 1015745C, and U.S. Publication No. 2012/0167295 (hereinafter referred to as the '295 publication).

Valves, such as the valve described in the '295 publication and described in U.S. application Ser. No. 16/159,470 (hereinafter referred to as the '470 application), are generally umbrella-shaped and seal gas by forming a seal between a soft umbrella shaped membrane and the cartridge wall, which serves as an outer sealing body. Valves like that described in the '266 patent are similar to a duck bill style membrane that seals against itself.

Valves with a faster rate of fluid flow are also advantageous in floor drains and urinals, where flooding is a threat, and codes often call for a minimum rate of flow based on drain size, to assure flooding does not spread to other rooms due to a slow flowing valve at the entrance to the drain. Umbrella style valves, while having the advantage of allowing less restriction to flowing fluid, have the disadvantage of locking due to lack of air flow when overwhelmed with fluid.

Thus, a continuing need exists for a fluid control valve and housing configuration with the benefits of faster flow while still operating with only gravity force, and very low flow requirements as well.

SUMMARY OF INVENTION

The present invention relates to a resilient fluid control valve assembly and, more particularly, to a resilient fluid control valve assembly where a portion of the resilient fluid control valve resides above the opening of the urinal drain hole. The resilient fluid control valve assembly comprises a cartridge housing having an upper portion and a lower portion. The upper portion is formed to reside above a drain opening, and the lower portion is formed to reside within the drain opening. The resilient fluid control valve assembly further comprises a resilient fluid control valve positioned within the cartridge housing. The resilient fluid control valve has a valve body portion and a sealing portion. When positioned within the cartridge housing, at least a portion of the valve body portion resides above the drain opening, and at least a portion of the sealing portion resides within the drain opening.

In another aspect, the cartridge housing further comprise a plurality of valve guides formed to maintain the position of the fluid control valve assembly within the drain opening.

In another aspect, at least a portion of each valve guide is positioned above the drain opening.

In another aspect, the upper portion of the cartridge housing comprises a tubular structure comprising a plurality of apertures formed to allow fluid to enter.

In another aspect, the tubular structures covers the portion of the valve body portion residing above the drain opening.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
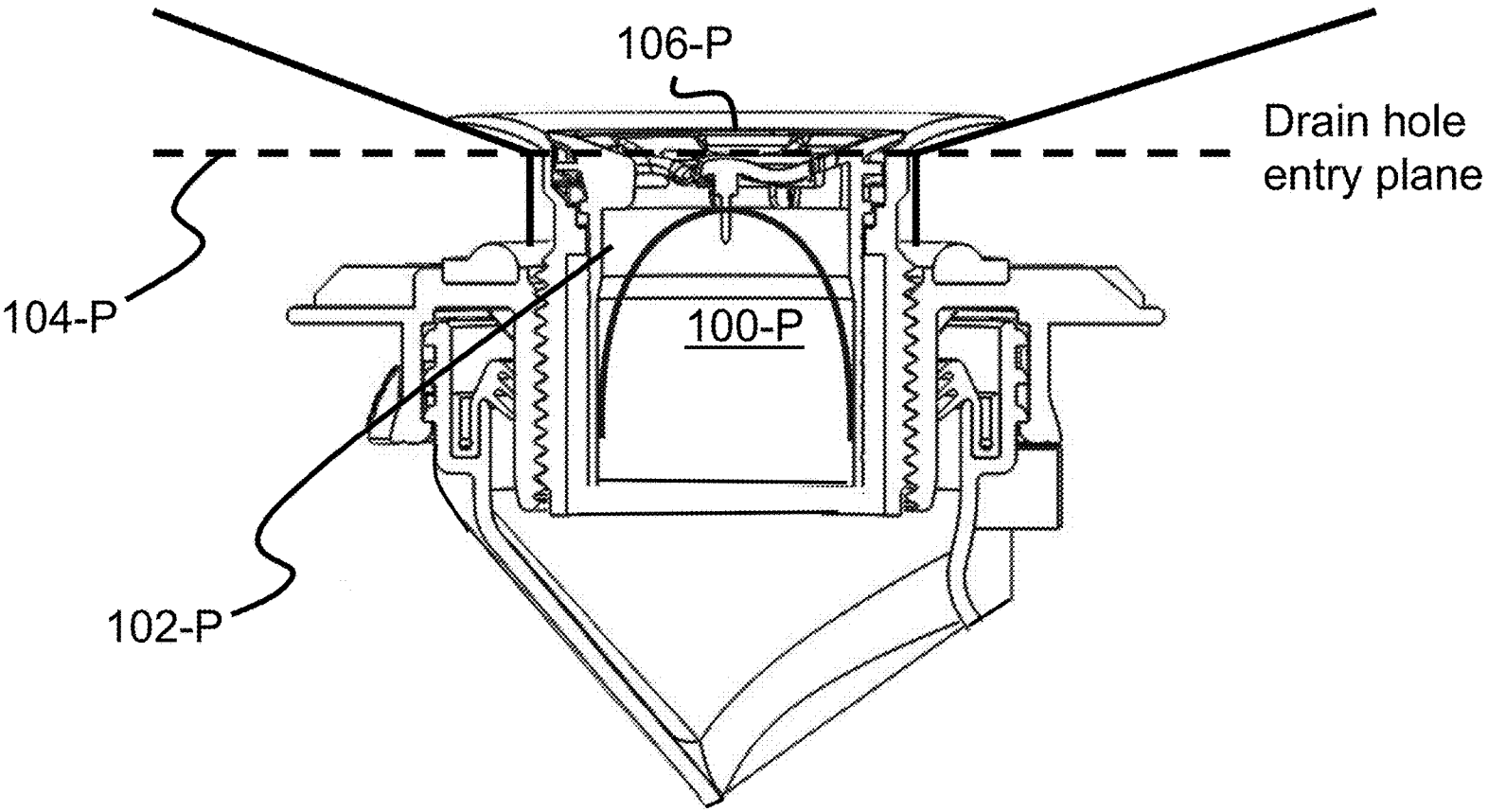
FIG. 1 (Prior Art)
FIG. 1 is a side, sectional-view illustration of a fluid control valve assembly positioned below a drain opening according to prior art.

The present invention relates to a resilient fluid control valve assembly and, more particularly, to a resilient fluid control valve assembly where a portion of the resilient fluid control valve resides above the opening of the urinal drain hole. The following description is presented to enable one of ordinary skill in the art to make and use the invention and to incorporate it in the context of particular applications. Various modifications, as well as a variety of uses, in different applications will be readily apparent to those skilled in the art, and the general principles defined herein may be applied to a wide range of embodiments. Thus, the present invention is not intended to be limited to the embodiments presented, but is to be accorded with the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter-clockwise have been used for convenience purposes only and are not intended to imply any particular fixed direction. Instead, they are used to reflect relative locations and/or directions between various portions of an object. As such, as the present invention is changed, the above labels may change their orientation.

(1) Introduction

Umbrella style valves are made up of a membrane shaped in an umbrella-like shape and placed inside a tubular structure, also referred to as a cartridge body or housing, that provides a sealing surface for the umbrella shaped valve. The cartridge body also provides a support structure that encompasses the entire valve and gives the valve a structure to hang from. The cartridge body, or housing, is closed on the sides, directing all fluid over the umbrella-shaped valve from the top down, as described in the '965 publication.

Umbrella style valves can be designed to allow a range of flow rates through them, but have some limitations. The valves must be thin and highly flexible and resilient, to allow the low force of gravity and small amounts of fluid to open them. If the valve is made too thin, it may be affected by the buildup of solids (e.g., precipitates), or deformed by small amounts of cleaning fluids. Thus, there is a limit on how thin one can make the valve.

Another important aspect of the umbrella style valve is the admittance of air past the sealing area of the valve. In many cases, the valve can also be overwhelmed by fluid flow. In action, the valve deforms as fluid flows past the sealing area. However, if there is additional fluid above the sealing area, this can seal off any air entering the drain pipe, thereby slowing flow. The membrane material stiffness and length of the sealing area will affect how much friction is created as fluids try to pass between the valve and the wall of the cartridge housing. The transition between the sealing area and the rest of the valve body can have a large effect on throughput velocity as this transition creates a stiffness. This is due to the added stiffness that occurs as the valve transitions from the sealing area to the valve body. The sealing area must have a downward sloping angle to allow fluid to flow through and not remain sitting on the sealing area, where solids may be deposited. A steeper angle of the sealing area can self-clean by dripping dry, better than a flatter angle, thus it is desirable. However, when an umbrella valve is designed to be short in height with a desirable steep sealing area, a sharp angle can be created between the two sections. This can create an undesirable stiffness. An umbrella valve with a taller height can have a lower angle between the sealing area and the valve body; however, this takes up more height which can be undesirable, and creates more chance that the valve may be overwhelmed by heavy fluid flows that block air from being admitted due to the tall tubular structure above the sealing area being filled with fluid.

Thus, a taller valve can have a steep sealing surface and a very gradual taper inward to create a closed shape, but it requires significant height to achieve this, whereas a short valve will need to have a much sharper transition angle between the sealing area and the valve body, creating undesired stiffness but allowing a lower total height which is desirable. The fluid control valve described herein provides a solution to the aforementioned problems in two regards. First, it raises the valve body above the drainage plane (i.e., plane of the drain), allowing a tall valve to be used, with a low angle between the sealing area and the valve body. Second, it allows fluid to enter the tubular structure (i.e., cartridge body, cartridge housing) through the side, just above the sealing area, while still providing a structure for the valve body to hang from. This second element avoids the valve being overwhelmed by higher fluid flows which can choke off any air from being admitted to the drainage pipe and slow flows. Each of these aspects will be described in further detail below.

(2) Specific Details of Various Embodiments

Described is a resilient, umbrella style fluid control valve assembly that allows a least a portion of the fluid control valve to reside above a drain hole entry when placed inside a urinal drain, which will be described in further detail below after first describing existing valves.

FIG. 1 illustrates a side, sectional-view of a prior art fluid control valve assembly comprising a fluid control valve 100-P and a cartridge housing 102-P, such as that described in the '295 publication. The dotted line indicates the drain hole entry plane 104-P, which is the plane of the drain opening 106-P, where waste and flushing water flow into the entry of the valve 100-P. As shown, the prior art valve 100-P itself is located below the drain opening 106-P. As described above, the fluid control valve 100-P seals gas by forming a seal with the interior walls of the cartridge housing 102-P.

Figure 2:
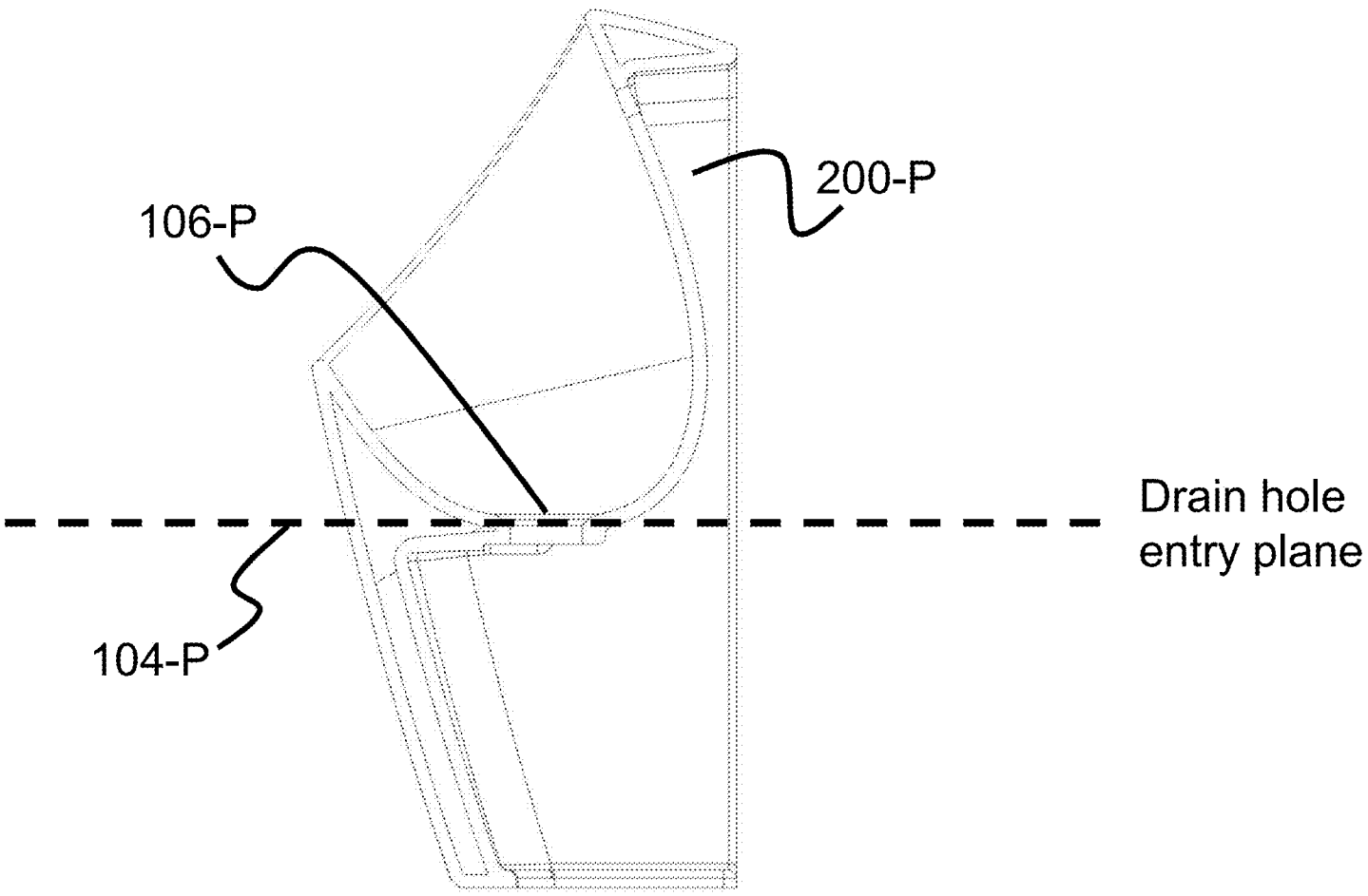
FIG. 2 (Prior Art)
FIG. 2 is a side, sectional-view illustration of a urinal showing the drain hole entry plane at a lowest point of the urinal according to prior art.

FIG. 2 illustrates a side view of a urinal 200-P showing the drain hole entry plane 104-P at a lowest point of the urinal 200-P, where waste and flushing water enter the drain. In existing valve and housing combinations, the fluid control valve 100-P sits below the drain hole entry plane 104-P.

Figure 3:
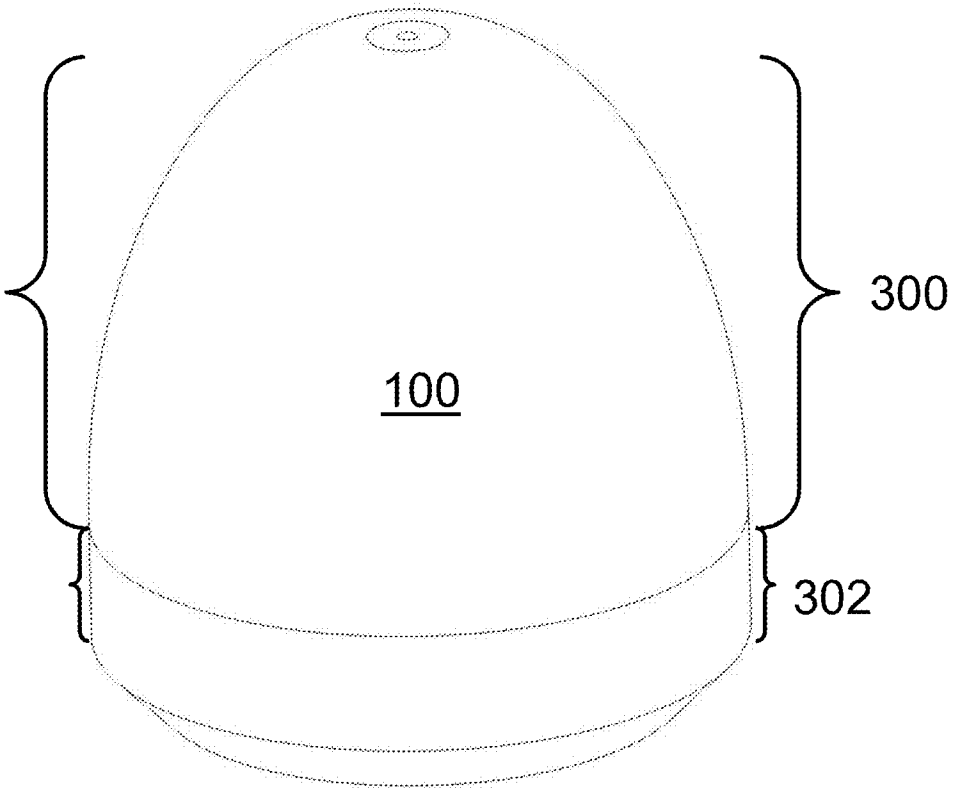
FIG. 3 is a front, perspective-view of a resilient fluid control valve assembly according to embodiments of the present disclosure.

FIG. 3 depicts the umbrella style, resilient fluid control valve 100 according to embodiments of the present disclosure, shown outside of a cartridge housing. While the fluid control valve 100 is a single structure, the portions of the fluid control valve 100 will be defined for clarity. The portion of the fluid control valve 100 that sits above the drain hole entry will be referred to as the valve body 300. The portion of the fluid control valve 100 that sits tangent to or just below the drain entry will be referred to as the sealing portion 302, which is the portion of the fluid control valve 100 that interfaces with the cartridge housing to create a seal. The fluid control valve 100 can be comprise of any suitable resilient material (or materials) provided that it can deform easily and then return to its original shape. Non-limiting examples of resilient materials include silicone, thermoplastic elastomer (TPE), thermoplastic starch (TPS), rubbers, or any other resilient material (or materials) that can deform easily and then return to its original shape. As a substantial portion of the fluid control valve (i.e., the valve body 300) resides above the drain hole entry (in contrast to prior art) and at least a portion of the sealing portion 302 sits tangent to or just below the drain entry, fluids can enter the fluid control valve 100 from both the side and from the top, whereas in existing valves (e.g., 100-P), fluid can only enter from the top due to the positioning below the drain opening 106-P.

Figure 4:
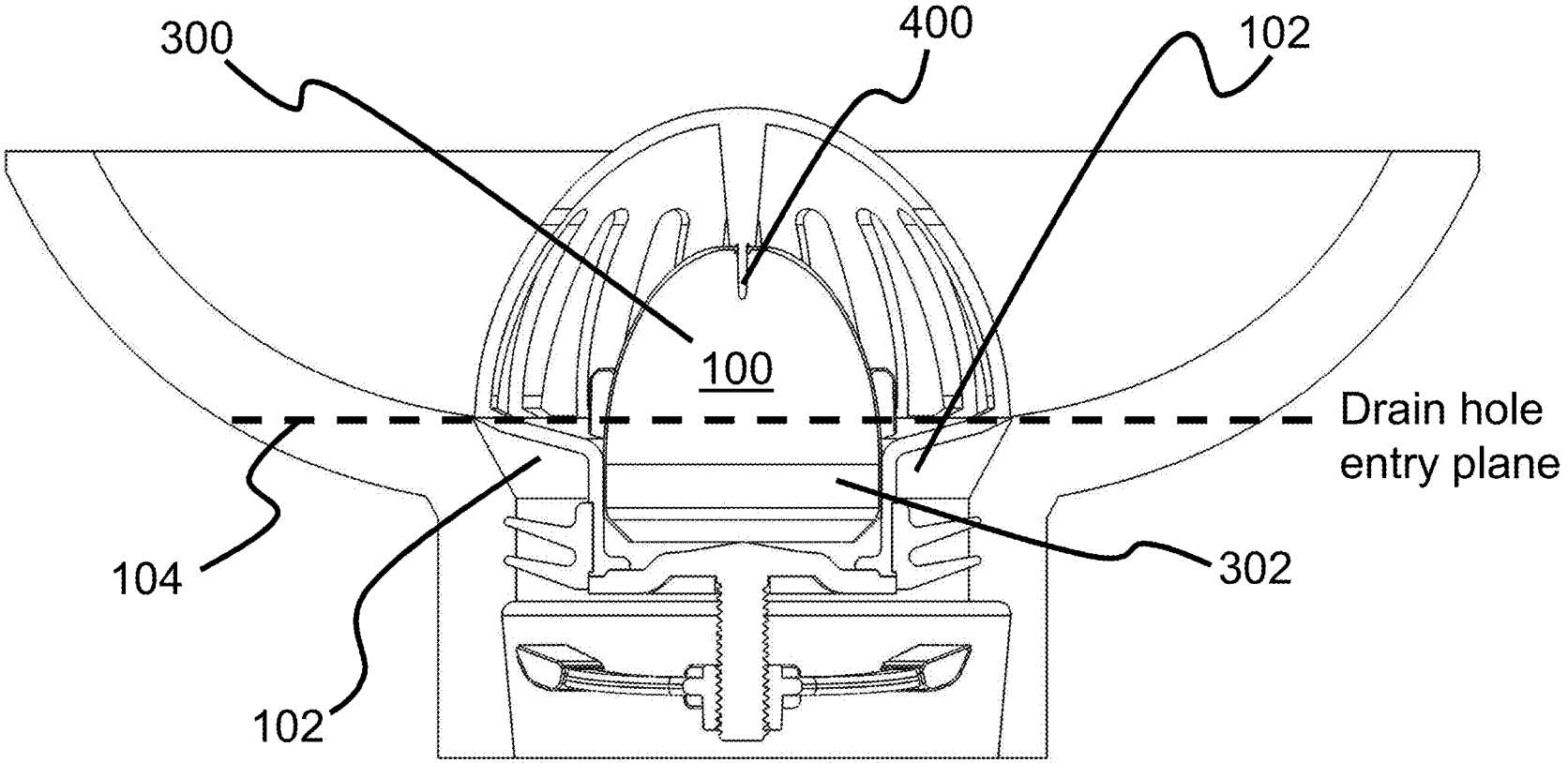
FIG. 4 is a side, sectional-view illustration of a resilient fluid control valve assembly positioned above a drain opening according to embodiments of the present disclosure.

FIG. 4 illustrates a side, sectional view of the fluid control valve 100 positioned within a cartridge housing 102, showing the valve body 300 positioned above the drain hole entry plane 104. The top of the fluid control valve 100 (i.e., top of the valve body 300) is reversibly connected with the cartridge housing 102 by a retaining clip 400, or any other known means, such that the fluid control valve 100 can be removed from the cartridge housing 102 for replacement, if desired. The cartridge housing 102 is sized to fit within drain opening of a urinal (or other drain type). The combination of the fluid control valve 100 and the cartridge housing 102 in which the fluid control valve resides make up the fluid control valve assembly described herein. Note, the sealing portion 302, and, therefore, at least a portion of the fluid control valve 100, remains below the drain hole entry plane 104. This allows for a large valve body 300, where just a portion of the fluid control valve 100 sits slightly below the drain opening.

Figure 5:
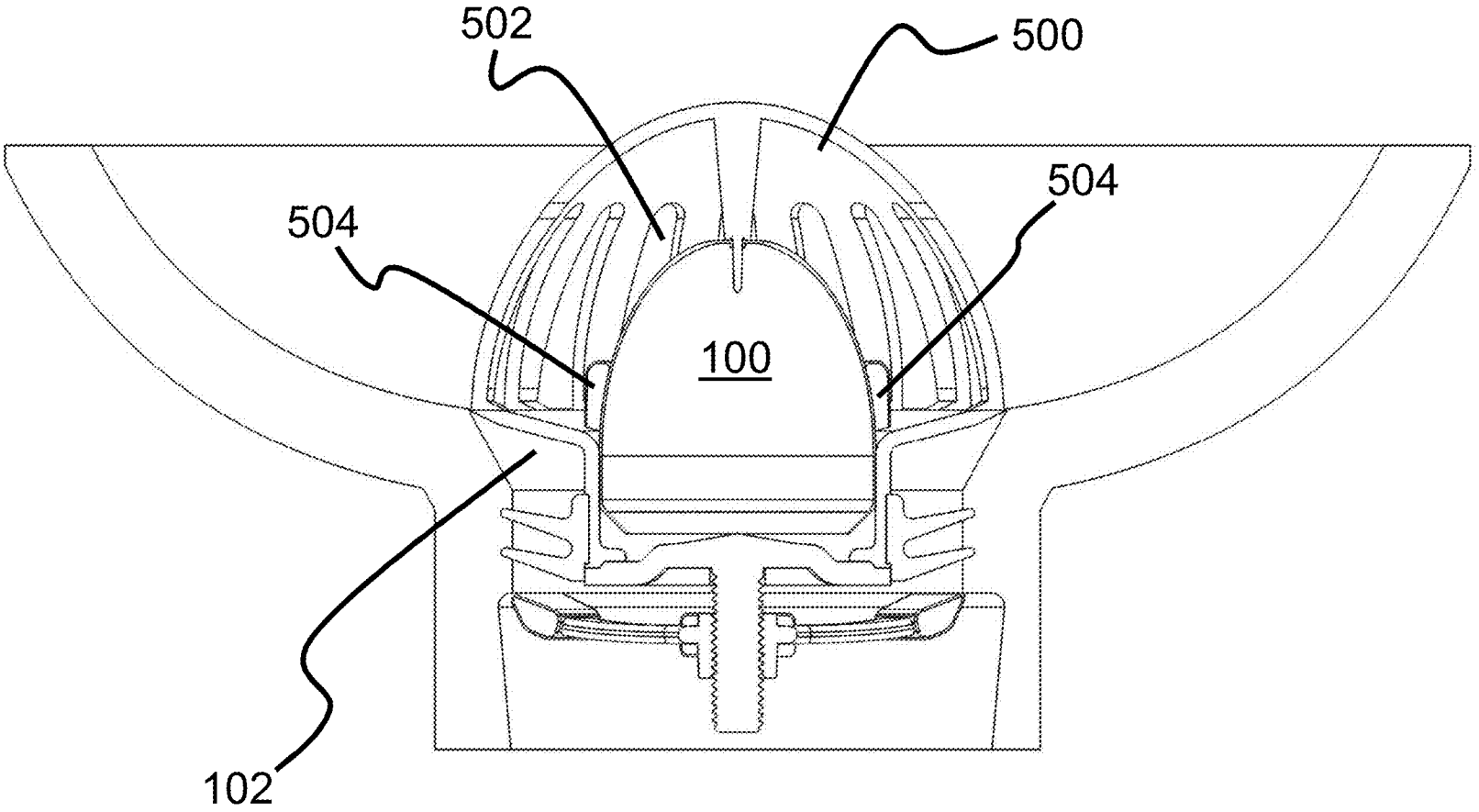
FIG. 5 is a side, sectional-view illustration of a resilient fluid control valve assembly positioned above a drain opening with valve guides according to embodiments of the present disclosure.

As shown in FIG. 5, the cartridge housing 102 further includes a tubular structure 500, or cage, positioned above the drain opening, that covers and surrounds the portion of the fluid control valve 100 that resides above the drain opening (i.e., the valve body 300 portion of the fluid control valve 100). The tubular structure has a plurality of apertures 502 (i.e., openings, slots, cut-outs) therein, which allow fluid to enter from the side just above the sealing portion 302. Due to potential back pressure, there is a danger of the valve 100 losing its sealing connection with the interior of the cartridge housing 102, thereby compromising the seal against backward migrating sewer gasses. To inhibit the valve 100 from slipping and losing its seal, the cartridge housing 102 further comprises a plurality of valve guides 504 to guide the flow of fluid, and maintain the fluid control valve 100 in position in the drain opening. The valve guides 504, or retaining members, also keep the fluid control valve 100 from turning inside out due to back pressure. The valve guides 504 are positioned at least partially above the drain opening to keep the fluid control valve 100 aligned so that it can perform its job of sealing off back migration of gas. The valve guides 504 can be formed of any suitable material, or combination of materials, non-limiting examples of which include plastic and metal materials. As can be appreciated by one skilled in the art, any number of valve guides 504 is possible, provided that they perform the function of keeping the fluid control valve 100 at least partially above and aligned with the drain opening of the urinal.

While the fluid control valve 100 described herein has a particular application in urinals (e.g., 200-P), it can be appreciated by one skilled in the art that it can have other similar applications and the components can be made of varying materials and made more robust to meet such applications without departing from the scope of the invention as defined in the appended claims.

Additionally, it will be readily apparent to persons skilled in the relevant arts that various modifications and improvements may be made to the foregoing embodiments, in addition to those already described, without departing from the basic inventive concepts of the present invention.

What is claimed is:

1. A fluid control valve assembly, comprising:

a cartridge housing having an upper portion and a lower portion, wherein the upper portion is formed to reside above a drain opening, and wherein the lower portion is formed to reside within the drain opening; and a resilient fluid control valve positioned within the cartridge housing, the resilient fluid control valve having an umbrella-shaped valve body portion and a sealing portion, wherein a height of the umbrella-shaped valve body portion is greater than a height of the sealing portion, wherein the umbrella-shaped valve body portion resides above the cartridge housing, wherein the sealing portion interfaces with the cartridge housing, creating a seal; and wherein when positioned within the cartridge housing, the umbrella-shaped valve body portion extends out of and above the drain opening, and the sealing portion resides within the drain opening, such that a greater portion of the resilient fluid control valve resides above the drain opening than below the drain opening.

2. The fluid control valve assembly as set forth in claim 1, wherein the cartridge housing further comprises a plurality of valve guides formed to maintain the position of the umbrella-shaped valve body portion above the drain opening.

3. The fluid control valve assembly as set forth in claim 2, wherein at least a portion of each valve guide is positioned above the drain opening.

4. The fluid control valve assembly as set forth in claim 1, wherein the upper portion of the cartridge housing comprises a cage positioned above the drain opening comprising a plurality of apertures formed to allow fluid to enter.

5. The fluid control valve assembly as set forth in claim 4, wherein the cage covers and surrounds the umbrella-shaped valve body portion above the drain opening.

* * * * *